US005739504A

United States Patent [19]

Lyons et al.

[11] Patent Number: 5,739,504

[45] Date of Patent: Apr. 14, 1998

[54] CONTROL SYSTEM FOR BOILER AND ASSOCIATED BURNER

[75] Inventors: Richard A. Lyons, Hamden; Christopher L. Murray, West Haven, both of Conn.

[73] Assignee: C. Cowles & Company, New Haven, Conn.

[21] Appl. No.: 508,467

[22] Filed: Jul. 28, 1995

[51] Int. Cl.[6] ..... H05B 1/02; F22D 5/26

[52] U.S. Cl. ..... 219/494; 219/492; 219/519; 219/481; 219/518; 392/324; 122/448.1

[58] Field of Search ..... 219/295, 494, 219/488, 481, 483, 501, 506, 508, 518, 519, 492; 392/327, 402, 324

[56] References Cited

U.S. PATENT DOCUMENTS

| | | | |
|---|---|---|---|
| 3,335,334 | 8/1967 | Albisser | 317/153 |
| 4,263,587 | 4/1981 | John | 340/620 |
| 4,360,738 | 11/1982 | Bartels | 307/118 |
| 4,482,891 | 11/1984 | Spencer | 340/620 |
| 4,565,930 | 1/1986 | Bartels | 307/118 |
| 4,716,858 | 1/1988 | Bartels | 122/448 |
| 4,841,770 | 6/1989 | Davies | 73/290 |
| 4,903,530 | 2/1990 | Hull | 73/304 |
| 4,952,779 | 8/1990 | Eaton-Williams | 219/295 |
| 5,110,418 | 5/1992 | Garrison et al. | 202/81 |
| 5,224,445 | 7/1993 | Gilbert, Sr. | 122/448.1 |
| 5,440,668 | 8/1995 | Jones | 392/327 |

*Primary Examiner*—Mark H. Paschall

*Attorney, Agent, or Firm*—DeLio & Peterson, LLC

[57] ABSTRACT

A control system for use with a boiler and associated burner. In one embodiment, the system comprises a first control circuit for producing a signal having alternating first and second states, the first state activating the burner and having a first predetermined duration, the second state deactivating the burner and having a second predetermined duration that defines a time period that allows foam and surging fluid in the boiler to settle, and a relay responsive to the first control circuit signal and adapted for connection to a power source and the burner, when the first control circuit signal has the first state, the relay connects the power source to the burner to activate the burner, when the first control circuit signal has the second state, the relay disconnects the power source from the burner to deactivate the burner. In another embodiment, the system further includes a sensor for continually monitoring the fluid level in the boiler, the sensor producing a signal having a first state indicating that the fluid level in the boiler is at or above a predetermined level and a second state indicating that the fluid level in the boiler is below the predetermined level, and a second control circuit responsive to the sensor signal and having an output coupled to the relay, the second control circuit producing a signal having a first state in response to the first state of the sensor signal and a second state in response to the second state of the sensor signal, the relay connecting the power source to the burner when the first and second control circuit signals have the first state and disconnecting the power source from the burner to deactivate the burner when the first control circuit signal or the second control circuit signal has the second state.

10 Claims, 2 Drawing Sheets

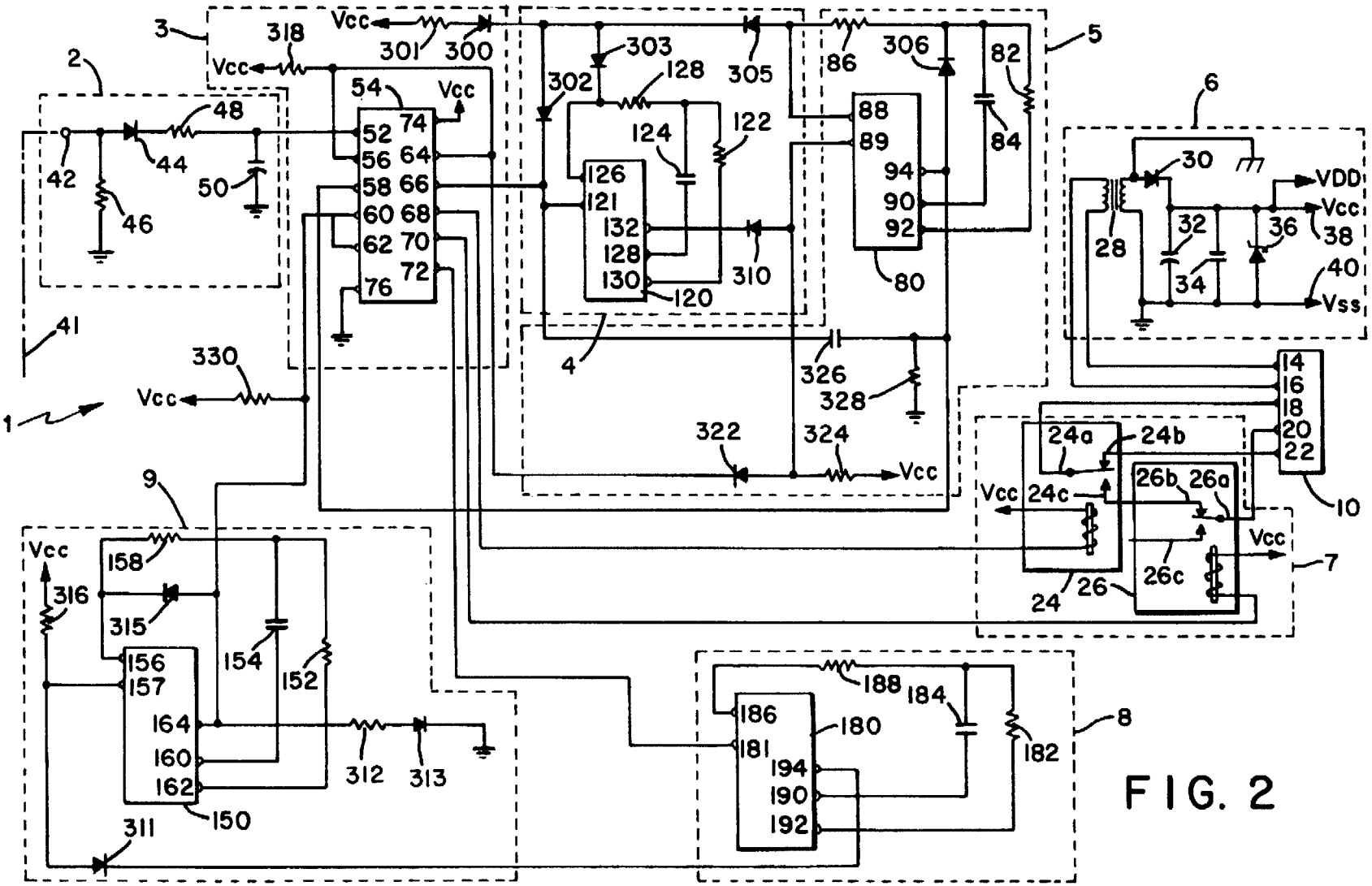
VDD
Vcc
Vss
Vcc
Vcc
Vcc

CONTROL SYSTEM FOR BOILER AND ASSOCIATED BURNER

BACKGROUND OF THE INVENTION

1. Field of the Invention

The present invention is directed to a control system for use with a boiler and an associated burner.

2. Problem to be Solved

Steam boilers used for heating and process steam applications require a minimum level of water to function properly and safely. Failure to maintain an adequate water level within the boiler can result in severe boiler damage and in some circumstances, can lead to boiler explosions.

A common method of monitoring the water level in a steam boiler is the electronic probe-type low water cut-off. This device shuts down the burner in the event that the water falls below the lowest safe level. Such a system uses an electronic sensor that consists of two electrodes. One of the electrodes protrudes directly into the boiler through a tapping provided by the boiler manufacturer. The second electrode is the conductive boiler shell electrically connected to the mounting nut of the sensor. The resistance of the boiler liquid, generally water, completes the circuit path between the electrode sensor in the boiler water and the boiler shell. When the liquid level drops below the sensor level, the circuit is interrupted and the control removes power from the burner. Because the water level in a steam boiler can be very turbulent, a short time delay is designed into probe-type controls to prevent short cycling of the burner circuit during momentary dips in the water level.

Under some operating conditions, common in poorly maintained boilers, the aforementioned probe-type cut-offs are limited in their ability to sense the true water level. If a steam boiler is not properly maintained through periodic cleaning, foam can generate within the boiler which can be as conductive as water and consequently fall within the detection range of conventional probe-type low water cut-offs. For example, in extreme conditions, the water level in the boiler may drop below the sensor to an unsafe operating level. Foam on top of the boiler water, still at the sensor level, can complete the circuit path between the sensor and the boiler shell ground. Thus, although the probe-type low water cut-off is no longer sensing the true water level, the fuel supply to the burner remains uninterrupted.

The problem described above is becoming more acute as the industry moves to smaller, more efficient boilers. Since these newer boilers have considerably lower water content than boilers manufactured years ago, contamination and foaming occur more quickly. In addition, since these boilers hold less water, they are more susceptible to low water conditions.

Bearing in mind the problems and deficiencies of the prior art, it is therefore an object of the present invention to provide a control system and process for periodically interrupting the fuel supply to a burner of a steam boiler so as to allow the liquid and foam in the boiler to settle so that a probe-type low water cut-off sensor can sense the true liquid level in the boiler.

It is another object of the present invention to provide a control system and process that periodically interrupts the fuel supply to a burner of a steam boiler to allow the liquid and foam in the boiler to settle and then measures the true liquid level in the boiler.

Still other objects and advantages of the invention will in part be obvious and will in part be apparent from the specification.

SUMMARY OF THE INVENTION

The above and other objects and advantages of the present invention, which will be apparent to those skilled in the art, are achieved in the present invention which is directed, in a first aspect, to a control system for use with a boiler having a fluid therein and an associated burner comprising:

a first control circuit for producing a signal having alternating first and second states wherein the first state activates the burner and has a first predetermined duration and the second state deactivates the burner and has a second predetermined duration that defines a time period that allows foam and surging fluid in the boiler to settle; and a relay responsive to the first control circuit signal and adapted for connection to a power source and the burner. When the first control circuit signal has the first state, the relay connects the power source to the burner to activate the burner. When the first control circuit signal has the second state, the relay disconnects the power source from the burner to deactivate the burner.

In one embodiment, the control system further comprises:

a sensor for continually monitoring the fluid level in the boiler. The sensor produces a signal having a first state that indicates the fluid level in the boiler is at or above a predetermined level and a second state that indicates the fluid level in the boiler is below the predetermined level; and a second control circuit responsive to the sensor signal and having an output coupled to the relay. The second control circuit produces a signal having a first state in response to the first state of the sensor signal and a second state in response to the second state of the sensor signal. The relay connects the power source to the burner when the first and second control circuit signals have the first state and disconnects the power source from the burner to deactivate the burner when the first control circuit signal or the second control circuit signal has the second state.

In a related aspect, the present invention is directed to a control system for use with a boiler having fluid therein and an associated burner, comprising:

a first control circuit for producing a signal having alternating first and second states. The first state activates the burner and has a first predetermined duration. The second state deactivates the burner and has a second predetermined duration that defines a time period that allows foam and surging fluid in the boiler to settle. The first control circuit includes:

a first timing circuit for producing the first predetermined duration, and a second timing circuit for determining the second predetermined duration;

a relay responsive to the first control circuit signal and adapted for connection to a power source and the burner. When the first control circuit signal has the second state, the relay connects the power source to the burner to activate the burner. When the first control circuit signal has the second state, the relay disconnects the power source from the burner to deactivate the burner;

a sensor for continually monitoring the fluid level in the boiler. The sensor produces a signal having a first state indicating that the fluid level in the boiler is at or above a predetermined level and a second state indicating that the fluid level in the boiler is below the predetermined level; and a second control circuit responsive to the sensor signal and having an output coupled to the relay. The second control circuit produces a signal having a first state in response to the first state of the sensor signal and a second state in response to the second state of the sensor signal. The relay connects the power source to the burner when the first and second control circuit signals have the first state and disconnecting the power source from the burner to deactivate the burner when the first control circuit signal or the second control circuit signal has the second state.

In further aspect, the present invention is directed to a process for controlling a boiler having a fluid therein and an associated burner comprising the steps of:

a) providing a control system comprising a sensor for monitoring the fluid level in the boiler and outputting a signal that indicates either the fluid in the boiler is below a predetermined level or is at or above the predetermined level, a first control circuit for producing a signal having alternating first and second states wherein the first state has a first predetermined duration and a second state having a second predetermined duration. The second predetermined duration defines a time period that allows foam and surging fluid in the boiler to settle. The system further comprises a second control circuit responsive to the sensor signal for producing a control signal having a first state if the sensor signal indicates the fluid level is at or above the predetermined level and a second state if the sensor signal indicates that the fluid level is below the predetermined level. The system further comprises a relay responsive to the first control circuit signal and the second control circuit signal and adapted for connection to a power source and the burner. When the first control circuit signal and the second control circuit signal have the first state, the relay connects the power source to the burner to activate the burner and when the first control circuit signal or the second control circuit signal has the second state, the relay disconnects the power source from the burner to deactivate the burner;

b) alternately activating the burner for the first predetermined duration and deactivating the burner for the second predetermined duration;

c) continually monitoring the fluid level in the boiler to determine if the fluid is below the predetermined level;

d) disconnecting the power source from the burner if the burner is currently activated and if in step (c), it is determined that the fluid level is below the predetermined level; and e) maintaining the disconnection between the power source and the burner if the burner has already been deactivated in step (b) and if in step (c), it is determined that the fluid level is below the predetermined level.

In a related aspect, the present invention is directed to a process for controlling a boiler having fluid therein and an associated burner comprising the steps of:

a) alternately activating the burner for a first predetermined duration and deactivating the burner for a second predetermined duration. The second predetermined duration defines a time period that allows foam and surging fluid in the boiler to settle;

b) continually monitoring the fluid level in the boiler to determine if the fluid is below a predetermined level;

c) disconnecting the power source from the burner if the burner is currently activated and if in step (b), it is determined that the fluid level is below the predetermined level; and d) maintaining the disconnection between the power source and the burner if the burner was previously deactivated in step (a) and if in step (b), it is determined that the fluid level is below the predetermined level.

BRIEF DESCRIPTION OF THE DRAWINGS

The features of the invention are believed to be novel and the elements characteristic of the invention are set forth with particularity in the appended claims. The invention itself, both as to organization and method of operation, may best be understood by reference to the detailed description which follows taken in conjunction with the accompanying drawings in which:

FIG. 2 is a circuit diagram of the control system of the present invention.

DESCRIPTION OF THE PREFERRED EMBODIMENTS

Figure 1:
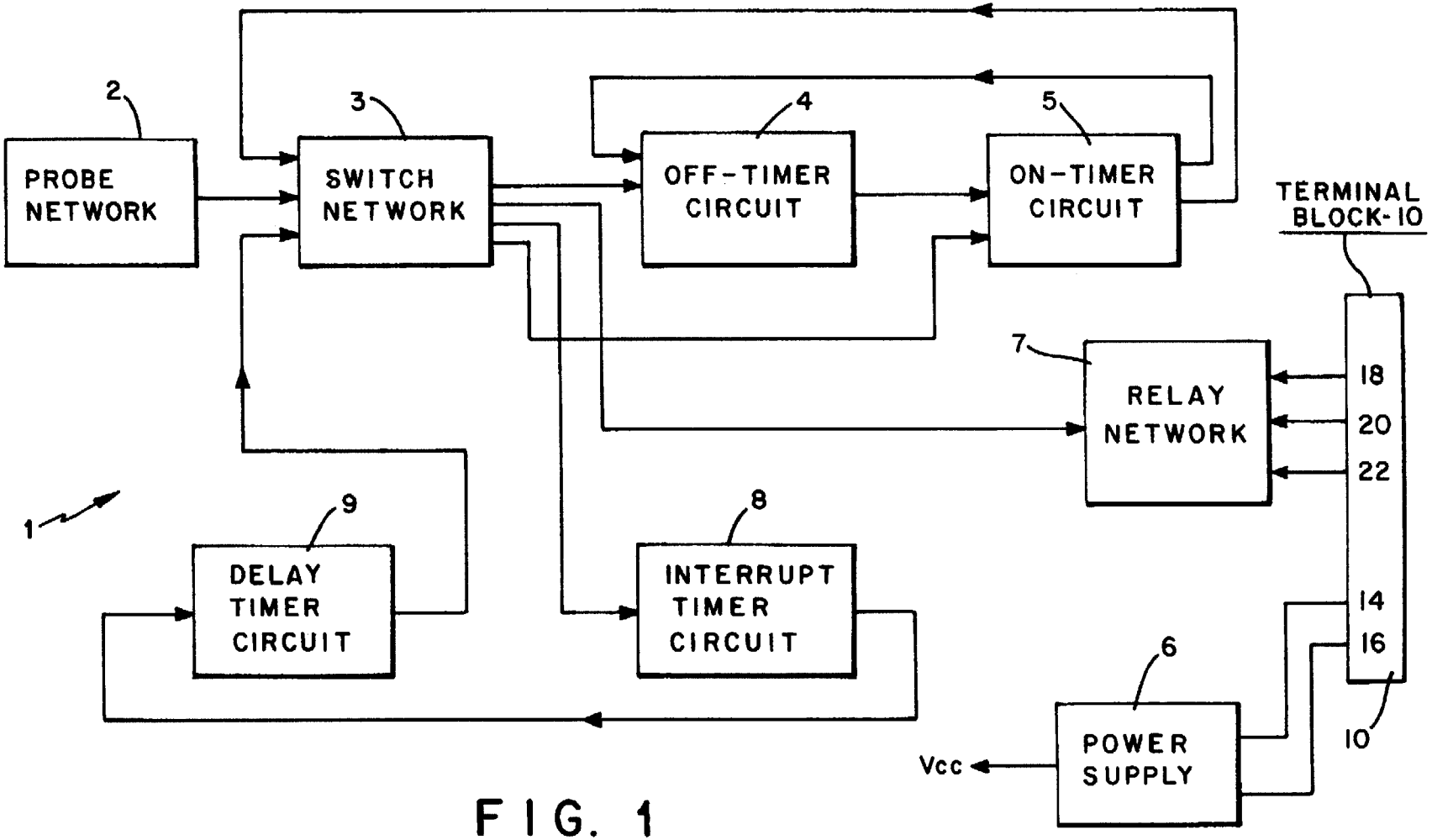
FIG. 1 is a block diagram of the control system of the present invention.

In describing the preferred embodiments of the present invention, reference will be made herein to FIGS. 1 and 2 of the drawings in which like numerals refer to like features of the invention.

In one embodiment, the present invention provides a control system that deactivates the burner at regular intervals to allow the foam and surging fluid to settle so that a probe-type cut-off can accurately monitor the fluid level in the boiler. In another embodiment, the present invention provides a control system that deactivates the burner at regular intervals to allow the foam and surging fluid in the boiler to settle and then accurately monitors the fluid or water level in the boiler.

A general block diagram of the control system of the present invention is shown in FIG. 1. Control system 1 generally consists of probe network 2, switch network 3, off-timer circuit 4, on-timer circuit 5, power supply circuit 6, relay network 7, interrupt-timer circuit 8, delay-timer circuit 9 and terminal block 10. Sensor network 2 includes a probe in the boiler and continually monitors the water level in the boiler. Sensor network 2 produces a signal having a first state indicating that the water level in the boiler is at or above a predetermined level and a second state indicating that the water level in the boiler is below the predetermined level. The output of sensor network 2 is inputted into switching network 3. In response to the signal received from sensor network 2, switch network 3 outputs signals to control off-timer circuit 4 and on-timer circuit 5. Off-timer circuit 4 and on-timer circuit 5 constitute a control that controls power to the burner by causing switching network 3 to send a signal to relay network 7 to either close or open the burner circuit. For example, if sensor network 2 outputs a signal indicating that the water level is at or above the predetermined level, switching network 3 outputs signals that disables off-timer 4 and enables on-timer 5. When on-timer 5 is enabled, it emits a signal to switching network 3 which outputs a signal to control relay network 7 to close the burner circuit. If sensor network 2 outputs a signal indicating that the water level is below the predetermined level, switching network 3 outputs signals that enables off-timer 4 and disables on-timer 5. When off-timer 4 is enabled, it emits a signal that causes switching network 3 to emit a signal that controls relay network 7 to open the burner circuit so as to deactivate the burner and to activate an alarm or an automatic water-feeder that will replenish the water in the boiler. Once the water is restored to the level of the probe, switch network 3 outputs a signal to disable off-timer 4 and enable on-timer 5 so as to re-activate.

Interrupt-timer circuit 8 and delay-timer circuit 9 constitute another control which is independent of the control comprising off-timer circuit 4 and on-timer circuit 5. Interrupt timer circuit 8 produces a control signal that has a first state for activating the burner via relay network 7, and a second state that deactivates the burner, via relay network 7, by interrupting the power to the burner (opening the burner circuit). The duration of the first state of the control signal is determined by interrupt timer circuit 8. The duration of the second state of the control signal is determined by delay-timer circuit 9. Thus, timer circuits 8 and 9 cooperate to deactivate the burner at regular intervals so as to allow the foam and surging water to settle in order for sensor network 2 to accurately monitor the fluid water level in the boiler. Upon the expiration of the predetermined duration, the control system returns to a normal mode of operation wherein the burner is controlled by signals produced by the cooperation of sensor network 2, off-timer circuit 4 and on-timer circuit 5.

A circuit diagram of control 1 system of the present invention is shown in FIG. 2. A power source for power supply 6 is supplied through terminals 14 and 16 of terminal block 10. Single-pole double-throw relay 24 comprises movable contact arm 24*a*, stationary contact arm 24*b* and open stationary contact arm 24*c*. Terminals 18 and 22 are coupled to the contacts 24*a* and 24*b*, respectively, of relay 24 of relay network 7. Contacts 24*a* and 24*b* are normally coupled to one another. Single-pole double-throw relay 26 comprises movable contact arm 26*a* and stationary contact arms 26*b* and 26*c*. Terminal 20 is connected to contact 26*a* of relay 26. Contact 26*b* of relay 26 is constantly connected to contact 24*c* of relay 24. Contacts 24*b* and 26*a* are normally coupled to one another. The burner circuit power supply lines are coupled to terminals 18 and 20 of terminal block 10. An alarm or automatic water feeder (not shown) is coupled to terminal 22. When the coil of relay 24 is energized and the coil of relay 26 is not energized, terminals 18 and 20 are coupled together to complete the burner circuit so as to activate the burner. If relay 24 is not energized, then terminal 18 is coupled to terminal 22 so as to power the alarm circuit or the automatic water or fluid feeder system which replenishes water or fluid to the boiler.

Step-down transformer 28 receives at its primary input, via terminals 14 and 16 of terminal block 10, about 120 v.a.c. or 24 v.a.c. (volts alternating current) and outputs 15 v.a.c. on its secondary output. Diode 30 serves as a rectifier to allow only the positive half of the a.c. voltage to charge polarized filter capacitor 32. Capacitor 34 filters higher frequency voltage spikes from the transformer 28 and filter capacitor 32. In a preferred embodiment, capacitors 32 and 34 have capacitances of 470 uf (microfarads) and 0.1 uf, respectively. Zener diode 36 acts as a voltage regulator to prevent the d.c. (direct current) output voltage, across terminals 38 and 40, from rising above 14 volts d.c.

Probe 41 is positioned in the boiler and is coupled to terminal 42. When water contacts probe 41, the water acts as a resistor between terminal 42 and chassis ground of transformer 28 thereby creating an a.c. voltage across the boiler water (between probe 41 and chassis ground). Diode 44 is forward biased only on the positive peak of the a.c. voltage. Resistors 46 and 48 act as a bridge to charge capacitor 50 when the resistance of the water is less than about 4,000 ohms. When capacitor 50 is charged, it provides a logic level "high" at terminal 52 of transistor array 54 of network 3. When the water level drops below probe 41, capacitor 50 discharges through resistors 46 and 48 thereby decreasing the voltage at terminal 52 to a logic level "low". In a preferred embodiment, resistors 46 and 48 have resistances of about 5.6 k and 10 k ohms, respectively, and capacitor 50 is polarized and has a capacitance of about 47 uf.

Transistor array 54 consists of seven (7) NPN transistors with the emitter of each transistor coupled to ground potential. The base of each transistor is coupled to a corresponding one of terminals 52, 56, 58, 60 and 62. The collector of each transistor is coupled to a corresponding one of terminals 64, 66, 68, 70 and 72. Terminal 74 is a common terminal and is coupled to the power supply voltage Vcc. Terminal 76 is the ground terminal and is coupled to ground potential. A positive voltage on the base of a particular transistor will forward bias the base-to-emitter junction of that transistor thereby saturating the transistor. When the transistors are saturated, the voltage potential between the collector of each transistor and ground decreases to about zero (0) volts. A low voltage on the base of a particular transistor will cause the transistor to "turn off" thereby causing the collector voltage of that particular transistor to rise to about 12 volts d.c. In a preferred embodiment, transistor array 54 is a Darlington transistor array. Preferably, transistor array 54 is a ULN2000 series Darlington transistor array manufactured by Texas Instruments of Dallas, Tex. Resistor 318 biases the base of the second transistor (terminal 56) to a logic "1" or logic high level to saturate the transistor. Resistor 318 preferably has a resistance of about 4.7 k ohms. Resistor 330 biases the bases of the fourth and fifth transistors (terminals 60 and 62) at a logic "1" level. Preferably, resistor 330 has a resistance of about 10 k ohms.

On-timer circuit 5 comprises fourteen (14) stage binary counter/divider 80. Resistor 82 and capacitor 84 form an RC timing circuit. The time constant is equal to the resistance of resistor 82 multiplied by the capacitance of capacitor 84. In a preferred embodiment, resistor 82 has a resistance of 330 k ohms and capacitor 84 has a capacitance of about 0.22 uf. Such resistor and capacitor values produce a time constant of about 0.00726 seconds. Thus, the period of one (1) cycle is about 0.01452 seconds. The voltage waveform produced by resistor 82 and capacitor 84 is fed back through resistor 86 to terminal 88 which is the clock input of counter 80. In response to this input voltage at terminal 88, counter 80 outputs a periodic square wave signal on terminals 90 and 92 which has a frequency of about 68.87 Hz (hertz) (68.87 Hz=1/0.01452 seconds). Each stage of counter 80 divides the frequency in half. Thus, the twelfth stage produces a 0.0168 Hz square wave periodic signal at terminal 94. This signal has a peak voltage amplitude of about 12 volts and a 50% duty cycle. ($0.0168\ Hz=68.87\ Hz*1/2^{11}=68.97\ Hz*1/4096$; * denotes multiplication). Resistor 328 holds the reset pin (terminal 89) of counter/divider 80 at a logic "0" level. Resistor 328 preferably has a resistance of about 100 k ohms. Capacitor 326 produces a pulse or spike having a significantly small pulse-width which is coupled to the reset pin (terminal 121) of counter/divider 120. In a preferred embodiment, capacitor 326 has a capacitance of about 0.1 uf. Resistor 324 holds the reset pin (terminal 89) of counter/divider 80 at a logic "1" level (or logic high). Resistor 324 preferably has a resistance of about 100 k ohms. Diode 322 becomes forward biased when terminal 64 (the collector of the first transistor) falls to a low-level. This occurs when the water in the boiler falls below the level of probe 41. When diode 322 is forward biased, the reset pin (terminal 89) of counter 80 is pulled down to a logic "0" level thereby resetting counter/divider 80.

Off-timer 4 includes fourteen (14)-stage binary counter/divider 120. Resistor 122 and capacitor 124 form an RC time constant. In a preferred embodiment, resistor 122 has a value of about 18 k ohms and capacitor 124 has a capacitance of about 0.1 uf. Thus, the time constant is about 0.0018 seconds. The waveform produced by this time constant is coupled to terminal 126 (the clock input) via resistor 128. Resistor 128 preferably has a resistance of about 220 k ohms. In response to the waveform input at terminal 126, circuit 120 outputs a 278 Hz square wave signal on terminals 128 and 130. Each stage of circuit 120 divides the frequency in half. Thus, the twelfth stage outputs a 0.0678 Hz square wave signal on terminal 132 which has a 50% duty cycle wherein the minimum voltage amplitude is about zero (0) volts and the maximum voltage amplitude is about 12 volts (0.678 Hz=278*1/4096). Resistor 320 holds the reset pin (terminal 121 ) at a logic "0" level. Thus, terminal 121 has a logic "0" level until it is pulled up to a logic "1" level.

Delay timer circuit 9 comprises fourteen (14)-stage binary counter/divider 150. Resistor 152 and capacitor 154 form an RC time constant. In a preferred embodiment, resistor 152 has a resistance of about 560 k ohms and capacitor 154 has a capacitance of about 0.1 uf. Thus, the time constant is about 0.001 seconds. The waveform produced by this time constant is coupled to terminal 156 (the clock input) via resistor 158. Preferably, resistor 158 has a resistance of about 680 k ohms. In response to the waveform input at terminal 156, circuit 150 produces an 8.93 Hz square wave oscillator on terminals 160 and 162. Each stage of circuit 150 divides the frequency in half. Thus, the fourteenth (14) stage of circuit 150 outputs a 0.000545 Hz square wave signal on terminal 164 which has a 50% duty cycle, a maximum amplitude of about 12 volts and a minimum amplitude of about zero (0) volts ($0.000545=8.93\ Hz*1/2^{13}=8.93\ Hz*1/4096$).

Interrupt-timer circuit 8 comprises fourteen (14)-stage binary counter/divider 180. Resistor 182 and capacitor 184 form an RC time constant. In a preferred embodiment, resistor 182 has a resistance of about 27 k ohms and capacitor 184 has a capacitance of 0.1 uf. Thus, the time constant is about 0.0027 seconds. Therefore, the period of one (1) cycle of the waveform is about 0.0054 seconds. The waveform produce by this time constant is coupled to terminal 186 (the clock input) via resistor 188. Resistor 188 preferably has a resistance of about 680 k ohms. In response to the waveform coupled to terminal 186, counter/divider 180 outputs a 185.19 Hz square wave signal on terminals 190 and 192 (185.19 Hz=1/0.0054 seconds). Each stage of circuit 180 divides the frequency in half. Thus, the fourteenth stage outputs a 0.011303 Hz square wave signal on terminal 194 (0.011303=185.19 Hz×1/16384) which has a 50% duty cycle, a minimum amplitude of about zero (0) volts and a maximum amplitude of about 12 volts.

Theory of Operation

The presence of water at the probe acts as a resistor between terminal 42 and the chassis ground. The use of the secondary winding of transformer 28 as chassis ground produces an a.c. voltage potential across the water in the boiler and at probe 41. Diode 44 is forward biased only on the positive peak of the a.c. voltage probe 41. Resistors act as a bridge to charge capacitor 50 when the resistance of the water is less than about 4,000 ohms. Capacitor 50, when charged, creates a positive voltage at the base (terminal 52) of a first transistor in transistor array 54. The positive voltage at terminal 52 saturates the first transistor in the array thereby effecting a collector (terminal 64) voltage equal to about ground potential. The low voltage on the collector (terminal 64) is coupled to the base of the second transistor of the array which "turns off" the second transistor thereby causing the collector (terminal 66) of the second transistor to increase from about ground potential to about 12 volts.

Terminal 66 is coupled to the cathodes of low-water level indicator LED (light emitting diode) 300 and diode 305, and the anodes of diodes 302 and 303. When the voltage potential at terminal 66 increases to about 12 volts, diode 300 becomes reverse biased thereby preventing current from flowing through diode 300. Thus, LED 300 is not illuminated when there is a voltage potential at terminal 42. Resistor 301 limits the current flow through diode 300 and preferably has a resistance of about 820 ohms. When the voltage potential at terminal 66 is about 12 volts, diode 302 is forward biased thereby providing about a 12 volt potential at terminal 121 (the reset terminal) thereby resetting counter/divider 120. Diode 303 is also forward biased and prevents counter/divider 120 from clocking due to any outside noise or interference. Diode 305 becomes reverse biased thereby removing the low voltage on terminal 88 (clock input) of counter/divider 80 thereby allowing counter/divider 80 to begin producing the 0.033 Hz square wave at terminal 94. Since the period of the 0.033 Hz waveform is 60 seconds with a 50% duty cycle, a pulse having an amplitude of 12 volts and a duration of 30 seconds is coupled to terminal 88 through diode 306 and resistor 86 and prevents counter/divider 80 from timing through another cycle.

The 12 volt potential on terminal 94 is also coupled to the base (terminal 58) of the third transistor of array 54 which allows that transistor to "turn on" and saturate. When the third transistor is on, the voltage potential at the collector (terminal 68) is decreased to approximately zero (0) volts or ground potential thereby creating a current flow through the coil of relay 24 thereby energizing the coil. When energized, contact **24*a* is coupled to contact 24*c* thereby coupling terminal 18 to terminal 20** so as to complete the burner circuit and initiate operation of the burner.

When the water level of the boiler drops below probe 41, capacitor 50 discharges thereby decreasing the voltage on the base (terminal 52) of the first transistor of array 54 to about zero (0) volts thereby turning off that transistor. Thus, the collector (terminal 64) of the first transistor increases to about 12 volts. Since the collector of the first transistor is coupled to the base of the second transistor, the second transistor becomes saturated thereby causing the collector (terminal 66) of the second transistor to decrease to about zero (0) volts. This low voltage on the collector (terminal 66) of array 54 forward biases the LED 300 such that diode 300 is illuminated. This low voltage potential on terminal 66 also reverse biases diode 302, which reduces the voltage at terminal 121 of counter/divider 120 to about 0 volts, and reverse biases diode 303 thereby shifting counter/divider 120 to the "on" state. Diode 305 becomes forward biased thereby providing about zero (0) volts on terminal 88 (clock input) of on-timer 80 so as to hold on-timer 80 in an "off" state. The voltage potential at terminal 132 of counter/divider 120 increases from about 0 volts to about 12 volts in approximately 8 (eight) seconds. If the water level in the boiler is restored to the level of probe 41 before the 8 seconds expires, the collector (terminal 66) of the second transistor of array 54 increases to about 12 volts. This voltage level will once again reset the counter/divider 80. The water level in the boiler must be below probe 41 for 8 consecutive seconds in order for counter/divider 120 to complete its cycle. When counter/divider 120 completes its cycle, the voltage potential at terminal 132 increases to about 12 volts which reverse biases diode 310 thereby providing 12 volts on terminal 89 (the reset input) of counter/divider 80 which causes counter/divider 80 to reset. When counter/divider 80 is reset, the voltage potential of terminal 94 decreases to about zero (0) volts. Since terminal 94 is coupled to the base (terminal 58) of array 54, the third transistor in the array turns "off" thereby increasing the voltage potential between the collector (terminal 68) and ground to about 12 volts. When terminal 68 has a voltage potential of about 12 volts, no current flows through the coil of relay 24. Thus, contact 24*a* is coupled to contact 24*b* which effects interruption of the burner circuit.

Delay-timer circuit 9 and interrupt-timer circuit 8 operate independently from off-timer circuit 4 and on-timer circuit 5. Circuits 8 and 9 use 14-stage binary counter/dividers 150 and 180, respectively. When control system 1 is powered-up, the base-emitter junction of fifth transistor of array 54 is reverse biased. Thus, the collector of the fifth transistor (terminal 72) is at a voltage potential of about 12 volts. Terminal 72 of array 54 is coupled to terminal 181 (the reset input) of counter/divider 180. This high voltage on terminal 181 causes counter/divider 180 to shift to the reset state. When counter/divider 180 is in the reset state, the voltage potential of terminal 194 is about 0 volts thereby forward biasing diode 311 which effects coupling of terminal 194 to terminal 157 (the reset input) of counter/divider 150. The resulting zero (0) volt level at terminal 157 allows counter/divider 150 to start counting (or timing) the delay period or delay time.

During the 15 minute delay time or period produced by counter/divider 150, the output of counter/divider 150 (terminal 164) is at about zero (0) volts which prevents current flow through resistor 312 and LED 313. Thus, LED 313 is reverse biased and does not illuminate. Resistor 312 limits the current flow through LED 313 and preferably has a resistance of about 820 ohms. LED 313 is preferably a green LED. Since the bases of the fourth and fifth transistors (terminals 60 and 62 of array 54) are coupled to terminal 164 of counter/divider 150, the two (2) transistors are in the "off" or cutoff state. The collector (terminal 72) of the fifth transistor is at a voltage potential of about 12 volts thereby holding counter/divider 180 in the reset state. The collector of the fourth transistor (terminal 70) is also at a voltage potential of about 12 volts which de-energizes the coil of relay 26. When the coil of relay 26 is de-energized, contact 26*a* is coupled to contact 26*b*. The burner circuit is complete when contact 26*a* is coupled to contact 26*b*, and contact 26*b* is coupled to contact 24*a*. Thus, in order for the burner circuit to be complete, relay 24 is energized, and relay 26 is de-energized.

After the 15 minute delay period expires, the voltage potential at terminal 164 of circuit 150 increases to about 12 volts which forward biases LED 313, which then becomes illuminated. Diode 315 also becomes forward biased thereby keeping counter/divider 150 from continuing through another cycle. The 12 volt potential on terminal 164 also forward biases the base-emitter junctions of the fourth and fifth transistors of array 54 thereby causing these transistors to become saturated. Thus, the voltage potential between the collector (terminal 72) and ground decreases to about zero (0) volts which lowers the voltage potential at terminal 181 (the reset input) of counter/divider 180 causing counter/divider 180 to begin its timing cycle. The voltage potential between the collector (terminal 70 of array 54), and ground also decreases to about zero (0) volts thereby energizing the coil of the relay 26 which interrupts power to the burner circuit (decouples terminal 18 from terminal 20. Thus, the burner remains inactive for about 45 seconds. During this 45 second time period, the foam and surging water in the boiler settle thereby allowing the water or fluid level in the boiler to be accurately monitored.

After the 45 second interrupt period expires, the voltage potential of terminal 194 of counter/divider 180 increases to 12 volts. Diode 311 then becomes reverse biased allowing terminal 157 (the reset input) of counter/divider 50 to be pulled up to 12 volts through resistor 316. Resistor 316 preferably has a resistance of about 100 k ohms. The 12 volt potential on terminal 157 shifts counter/divider 150 to the reset state. Once in the reset state, the voltage potential at terminal 164 decreases to about zero (0) volts thereby reverse biasing green LED 313. The low voltage potential at terminal 164 also causes base voltages at terminals 60 and 62 of the fourth and fifth transistors, respectively, of array 54, to decrease to about zero (0) volts causing each transistor to "turn off". When the fourth transistor is cutoff or turned off, the voltage potential between the collector (terminal 70 of array 54) increases to about 12 volts which de-energizes the coil relay 26. When the coil of relay 26 is de-energized, contact 26*a* is coupled to contact 26*b* to close the burner circuit i.e., a terminal 18 is coupled to terminal 20.

When the fifth transistor of array 54 is in cutoff, the voltage potential of the collector (terminal 72 of array 54)increases to about 12 volts. Since terminal 72 is coupled to terminal 181 (the reset pin) of counter/divider 180, counter/divider 180 shifts counter/divider 180 to the reset state. When interrupt-timer 180 is in the reset state, the voltage potential of terminal 194 decreases to about zero (0) volts which causes diode 311 to become forward biased. When diode 311 is forward biased, the voltage potential at terminal 157 (the reset input) of counter/divider 150 decreases to about zero (0) volts which causes counter/divider 150 to repeat the timing cycle.

In a preferred embodiment, counter/dividers 80, 120, 150 and 180 are CMOS CD4060 counter/dividers, all diodes, except zener diode 36, are IN4148 diodes and all resistors have a ¼ watt power rating and a 5% tolerance.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A control system for use with a boiler having a fluid therein and an associated burner, comprising:

a first control circuit for producing a signal having alternating first and second states, said first state activating the burner and having a first predetermined duration, said second state deactivating the burner and having a second predetermined duration that defines a time period that allows foam and surging fluid in the boiler to settle; and a relay responsive to said first control circuit signal and adapted for connection to a power source and the burner, when said first control circuit signal has said first state, said relay connects the power source to the burner to activate the burner, when said first control circuit signal has said second state, said relay disconnects the power source from the burner to deactivate the burner.

2. The control system of claim 1 further comprising:

a sensor for continually monitoring the fluid level in the boiler, said sensor producing a signal having a first state indicating that the fluid level in the boiler is at or above a predetermined level and a second state indicating that the fluid level in the boiler is below the predetermined level; and a second control circuit responsive to said sensor signal and having an output coupled to said relay, said second control circuit producing a signal having a first state in response to said first state of said sensor signal and a second state in response to said second state of said sensor signal, said relay connecting the power source to the burner when said first and second control circuit signals have said first state and disconnecting the power source from the burner to deactivate the burner when said first control circuit signal or said second control circuit signal has said second state.

3. The control system of claim 1 wherein said first control circuit comprises:

a first timing circuit for determining said first predetermined duration; and a second timing circuit for determining said second predetermined duration.

4. A control system for use with a boiler having fluid therein and an associated burner, comprising:

a first control circuit for producing a signal having alternating first and second states, said first state activating the burner and having a first predetermined duration, said second state deactivating the burner and having a second predetermined duration that defines a time period that allows foam and surging fluid in the boiler to settle, said first control circuit including:

a first timing circuit for producing said first predetermined duration, and a second timing circuit for determining said second predetermined duration;

a relay responsive to said first control circuit signal and adapted for connection to a power source and the burner, when said first control circuit signal has said second state, said relay connects the power source to the burner to activate the burner, when said first control circuit signal has said second state, said relay disconnects the power source from the burner to deactivate the burner;

a sensor for continually monitoring the fluid level in the boiler, said sensor producing a signal having a first state indicating that the fluid level in the boiler is at or above a predetermined level and a second state indicating that the fluid level in the boiler is below the predetermined level; and a second control circuit responsive to said sensor signal and having an output coupled to said relay, said second control circuit producing a signal having a first state in response to said first state of said sensor signal and a second state in response to said second state of said sensor signal, said relay connecting the power source to the burner when said first and second control circuit signals have said first state and disconnecting the power source from the burner to deactivate the burner when said first control circuit signal or said second control circuit signal has said second state.

5. A control system for use with a boiler having fluid therein and an associated burner, comprising:

a first control means for producing a signal having alternating first and second states, said first state activating the burner and having a first predetermined duration, said second state deactivating the burner and having a second predetermined duration that defines a time period that allows foam and surging fluid in the boiler to settle;

switch means responsive to said first control means signal and adapted for connection to a power source and the burner, when said first control means signal has said first state, said switch means connects the power source to the burner to activate the burner, when said first control means signal has said second state, said switch means disconnects the power source from the burner to deactivate the burner;

means for continually monitoring the fluid level in the boiler, said monitoring means producing a signal having a first state indicating that the fluid level in the boiler is at or above a predetermined level and a second state indicating that the fluid level in the boiler is below the predetermined level; and a second control means responsive to said signal from said monitoring means and having an output coupled to said switch means for producing a signal having a first state in response to said first state of said monitoring means signal and a second state in response to said second state of said monitoring means signal, said switch means connecting the power source to the burner when said first control means signal and said second control means signal have said first state and disconnecting the power source from the burner to deactivate the burner when said first control means signal or said second control means signal has said second state.

6. A process for controlling a boiler having a fluid therein and an associated burner comprising the steps of:

a) providing a control system comprising a sensor for monitoring the fluid level in the boiler and outputting a signal that indicates either the fluid in the boiler is below a predetermined level or is at or above the predetermined level, a first control circuit for producing a signal having alternating first and second states, said first state having a first predetermined duration and a second state having a second predetermined duration, said second predetermined duration defining a time period that allows foam and surging fluid in the boiler to settle, a second control circuit responsive to said sensor signal for producing a control signal having a first state if the sensor signal indicates the fluid level is at or above the predetermined level and a second state if the sensor signal indicates that the fluid level is below the predetermined level and a relay responsive to said first control circuit signal and said second control circuit signal and adapted for connection to a power source and the burner, when said first control circuit signal and said second control circuit signal have said first state, said relay connects the power source to the burner to activate the burner, when said first control circuit signal or said second control circuit signal has said second state, said relay disconnects the power source from the burner to deactivate the burner;

b) alternately activating the burner for said first predetermined duration and deactivating the burner for said second predetermined duration;

c) continually monitoring the fluid level in the boiler to determine if the fluid is below the predetermined level;

d) disconnecting the power source from the burner if the burner is currently activated and if in step (c), it is determined that the fluid level is below the predetermined level; and e) maintaining the disconnection between the power source and the burner if the burner has already been deactivated in step (b) and if in step (c), it is determined that the fluid level is below the predetermined level.

7. The process of claim 6 wherein step (d) further comprises the steps of:

replenishing the boiler with fluid; and re-connecting the power source to the burner to activate the burner.

8. The process of claim 6 wherein step (e) further comprises the steps of:

replenishing the boiler with fluid; and re-connecting the power source to the burner to activate the burner.

9. A process for controlling a boiler having fluid therein and an associated burner comprising the steps of:

a) alternately activating the burner for a first predetermined duration and deactivating the burner for a second predetermined duration, said second predetermined duration defining a time period that allows foam and surging fluid in the boiler to settle;

b) continually monitoring the fluid level in the boiler to determine if the fluid is below a predetermined level;

c) disconnecting the power source from the burner if the burner is currently activated and if in step (b), it is determined that the fluid level is below the predetermined level; and d) maintaining the disconnection between the power source and the burner if the burner was previously deactivated in step (a) and if in step (b), it is determined that the fluid level is below the predetermined level.

10. The process of claim 9 further including the steps of:

replenishing the boiler with fluid if in step (b), it is determined that the fluid level is below the predetermined level; and re-connecting the power source to the burner to activate the burner.

* * * * *

UNITED STATES PATENT AND TRADEMARK OFFICE

CERTIFICATE OF CORRECTION

PATENT NO. : 5,739,504

DATED : April 14, 1998

INVENTOR(S) : Richard A. Lyons and Christopher L. Murray

It is certified that error appears in the above-identified patent and that said Letters Patent is hereby corrected as shown below:

Column 5, line 2: Please insert - - the burner - - after the word re-activate.

Column 7, line 59: Please insert - - 46 and 48 - - after the word Resistors

Signed and Sealed this

Fourteenth Day of July, 1998

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,739,504

DATED : April 14, 1998

INVENTOR(S) : Lyons et al.

It is certified that error appears in the above-identified patent and that said Letters Patent is hereby corrected as shown below:

Column 2, line 57, delete "second" and insert therefor - - first - - .

Column 11, line 37, delete "second" and insert therefor - - first - - .

Signed and Sealed this

Second Day of May, 2000

*Attest:*

Q. TODD DICKINSON

*Attesting Officer*

*Director of Patents and Trademarks*